US006790120B1

(12) United States Patent
Murray

(10) Patent No.: US 6,790,120 B1
(45) Date of Patent: Sep. 14, 2004

(54) BALLOON VALVE ADAPTER FOR SUPPORTING DIFFERENT SIZES OF TOY BALLOONS AND ASSEMBLIES USING SAME

(76) Inventor: Robert H. Murray, 52 Manor Hill Dr., Fairport, NY (US) 14450

( * ) Notice: Subject to any disclaimer, the term of this patent is extended or adjusted under 35 U.S.C. 154(b) by 0 days.

(21) Appl. No.: 10/696,843

(22) Filed: Oct. 30, 2003

Related U.S. Application Data

(60) Provisional application No. 60/502,089, filed on Sep. 11, 2003.

(51) Int. Cl.[7] ..... A63H 3/06
(52) U.S. Cl. ..... 446/220
(58) Field of Search ..... 446/220, 221, 446/222, 223, 224, 225, 226

(56) References Cited

U.S. PATENT DOCUMENTS 3,881,531 A * 5/1975 Rossi ..... 141/313
5,145,338 A 9/1992 Murray
5,279,340 A * 1/1994 Scherr et al. ..... 141/313
5,322,101 A * 6/1994 Scherr et al. ..... 141/313
5,496,203 A 3/1996 Murray
5,547,413 A 8/1996 Murray

* cited by examiner

*Primary Examiner*—Jacob K. Ackun, Jr.

(57) ABSTRACT

A toy balloon valve adapter is provided for mounting over an existing balloon valve and for enabling the existing balloon valve to mate sealingly with different size balloons. The toy balloon valve adapter includes a continuous wall defining a balloon neck supporting member having a perimeter relatively different in size from a perimeter of the balloon neck supporting valve head of the toy balloon valve. The balloon neck supporting member includes a first end and a second end, wherein one of the first end and the second end is a relatively larger end and the other is a relatively smaller end. The toy balloon valve adapter also includes a cavity defined by the continuous wall and located between the first end and the second end for receiving and containing the valve head of a toy balloon valve. A first opening is provided into the cavity through the relatively larger end for receiving the valve head of the toy balloon valve into the cavity, and a second opening is provided through the relatively smaller end for allowing an inflation fluid to flow through the toy balloon valve into a supported balloon without leaking.

20 Claims, 5 Drawing Sheets

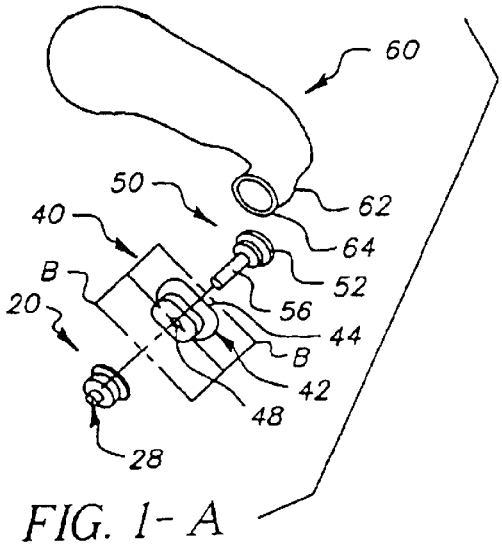
FIG. 1-A
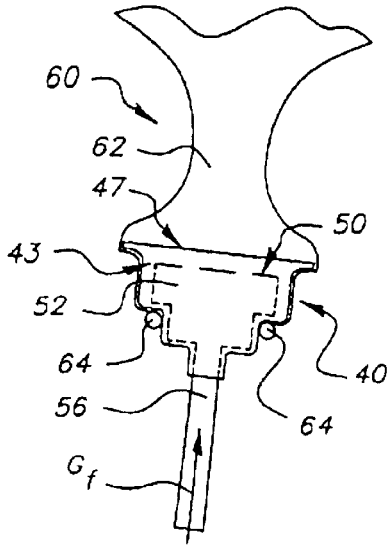
FIG. 1-B
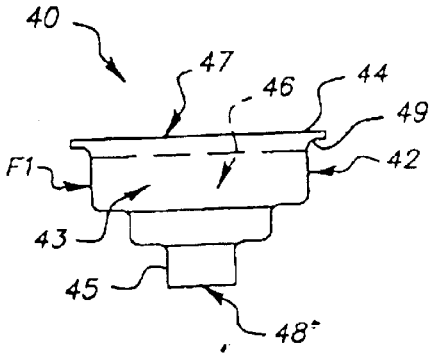
FIG. 1-C
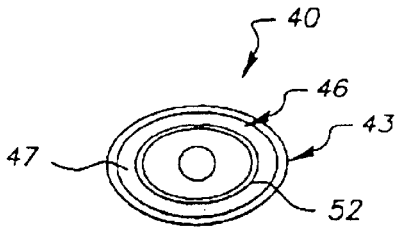
FIG. 1-D
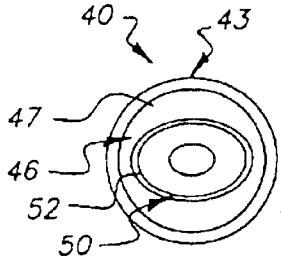
FIG. 1-F
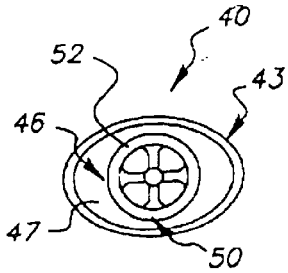
FIG. 1-E
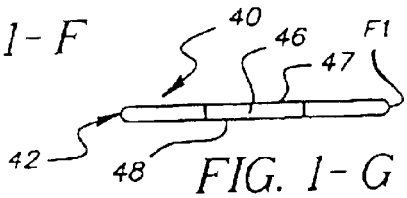
FIG. 1-G

BALLOON VALVE ADAPTER FOR SUPPORTING DIFFERENT SIZES OF TOY BALLOONS AND ASSEMBLIES USING SAME

This Application is based on a Provisional Patent Application No. 60/502,089 filed Sep. 11, 2003.

RELATED APPLICATIONS

This application is related to U.S. Pat. No. 5,496,203 "Balloon Valve Assembly U.S. Pat. No. 5,547,413 entitled "Heat-Staked Tether for Toy Balloons", and to U.S. Pat. No. 5,145,338 Low Pressure Pump".

FIELD OF THE INVENTION

This invention is directed to toy latex balloons and in particular to a toy balloon valve adapter for use on toy balloon valves to sealingly support different sizes of toy balloons including smaller and larger size balloons used for advertising display. This invention is also directed to means for securing a tether such as a ribbon to a balloon assembly using the balloon valve adapter of the present invention.

BACKGROUND

Helium-filled toy balloons that are given away as promotions at restaurants and other businesses are typically 9 to 11 inches in size. There are a number of existing balloon valves, for example the applicants U.S. Pat. No. 5,496,203 "Balloon Valve Assembly" that are available for supporting relatively small size balloons of approximately 4 to 12 inches in size and are therefore inflatable using such existing toy balloon valves. Unfortunately, relatively smaller neck size balloons as found on "animal twisties" do not fit sealingly on such existing balloon valves. Similarly too, relatively larger balloons such as 16, 17 and 25 inch size balloons that are typically used by automobile dealers to attract customer attention also do not fit sealingly on such existing balloon valves. This is because existing balloon valves are too small to effectively support and seal the necks of such larger sized balloons during inflation or after inflation. An obvious solution would be to make a dedicated smaller or larger sized balloon valve to accommodate each of the various sizes of balloons. However, this would require considerable expense as well as time to create the tooling.

There is therefore a need for a balloon valve adapter for enabling existing balloon valves to sealingly support different sizes of balloons. Additionally, because helium-filled balloons are lighter than air and, if not tethered will float up into the atmosphere and become lost, the present invention provides a means for attaching a tether to the balloon valve and adapter assembly. The most common solution to tethering toy balloons consists of tying a string or ribbon to the neck of the balloon after inflation. This is labor intensive and does not permit refilling the balloon with helium to replace helium that normally escapes through the pores of the inflated balloon.

Methods for securing the tether to the balloon support are:

1) Hand tying a knot, which is extremely labor intensive. Even with low cost labor, the problem is having sufficient labor available to meet high volume demand.

2) Stapling is another means of securing the tether to the support. One problem is the tether slipping from the staple. Another, the sharp staple points may cause injury.

3) Securing a ribbon by heat-staking, for example, Murray, U.S. Pat. No. 5,547,413 entitled "Heat-Staked Tether for Toy Balloons". Heat staking may allow for the ribbon being "pealed" from the support, thereby becoming detached. Another disadvantage is the complexity and expense of the equipment.

SUMMARY

In accordance with the present invention, there is provided a toy balloon valve adapter for enabling an existing balloon valve to mate sealingly with different size balloons including odd sized balloons. In a further embodiment of the invention a tether support device is provided for securing a tether to an assembly of a balloon, a balloon valve, and the balloon valve adapter, so as to retain the balloon and keep it from floating freely into the atmosphere.

BRIEF DESCRIPTION OF THE DRAWINGS

FIG. 1-A is an exploded view of the various parts used in the invention;

FIG. 1-B is a vertical cross section through plane B—B of FIG. 1-A;

FIG. 1-C is a side view of the balloon valve adapter of the present invention;

FIG. 1-D is a top view of a balloon valve head and an oval balloon valve adapter for use therewith;

FIG. 1-E is a top view of a round balloon valve head and an oval balloon valve adapter for use therewith;

FIG. 1-F is a top view of an oval balloon valve head and a round balloon valve adapter for use therewith;

FIG. 1-G is a second embodiment of the toy balloon valve adapter of the present invention;

Figure 2A:
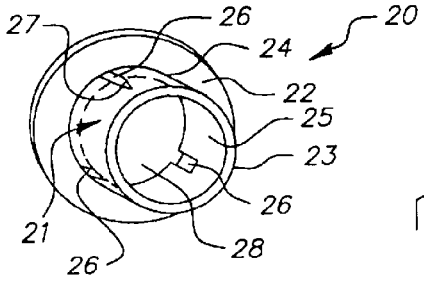
Figure 2B:
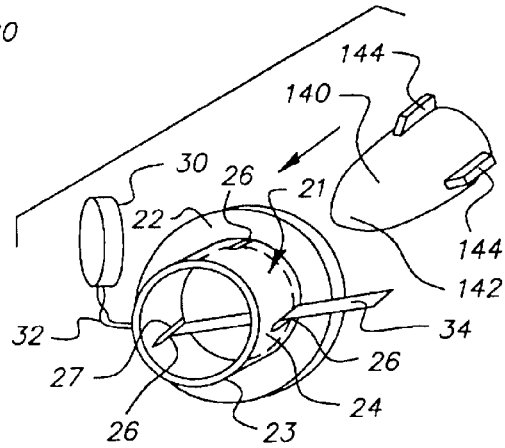
Figure 3:
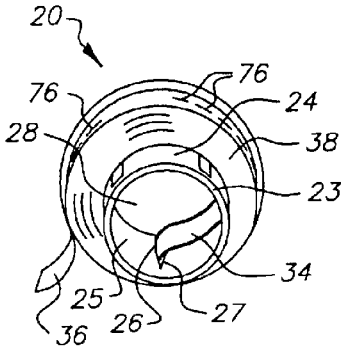
Figure 4:
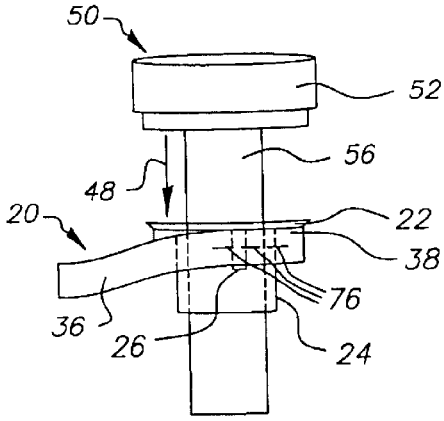
Figure 5:
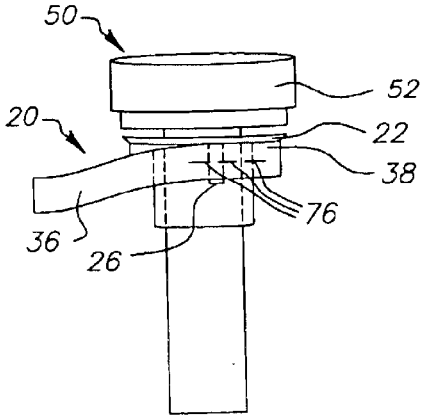
Figure 6:
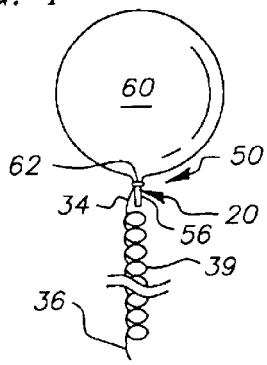
Figure 7A:
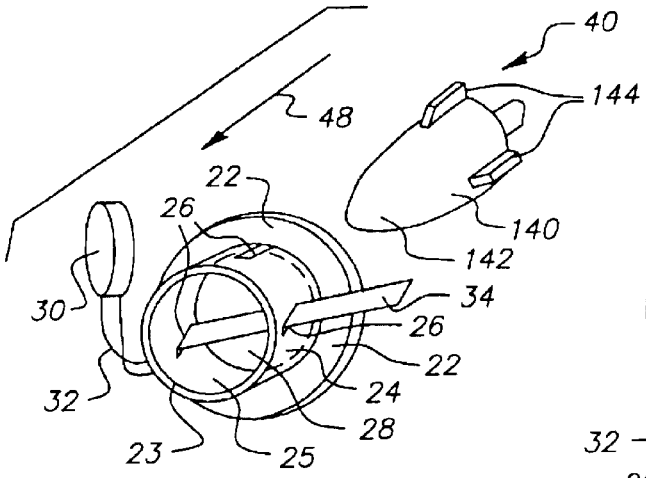
Figure 7B:
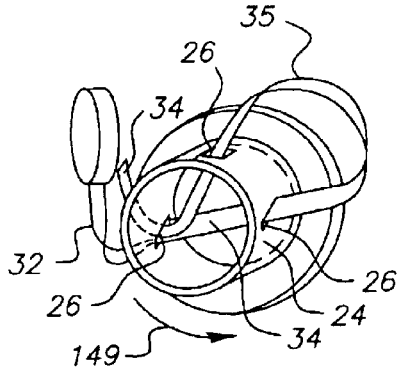
Figure 8A:
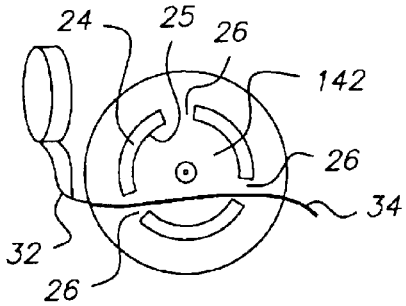
Figure 8B:
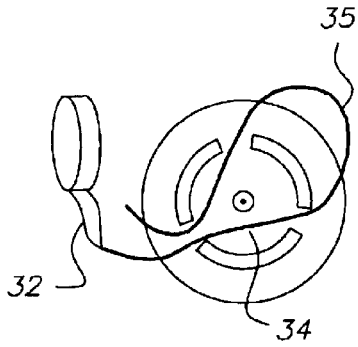
Figure 9A:
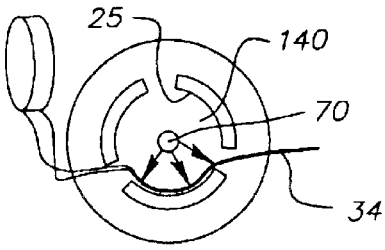
Figure 9B:
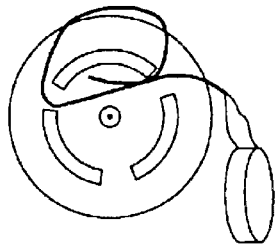
Figure 10:
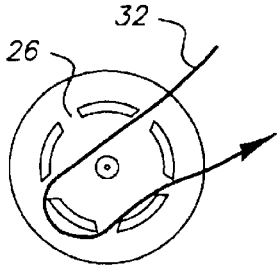
Figure 11:
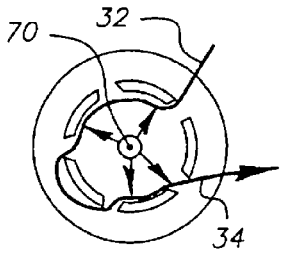
Figure 12:
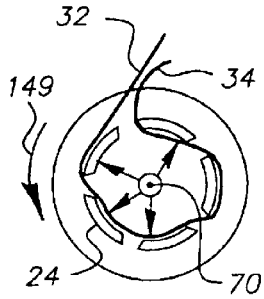
Figure 13:
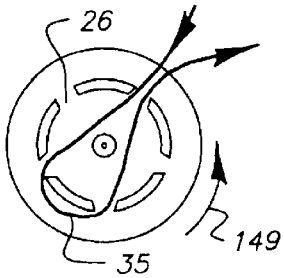
Figure 14:
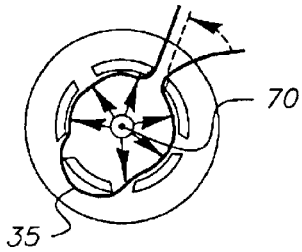
Figure 15:
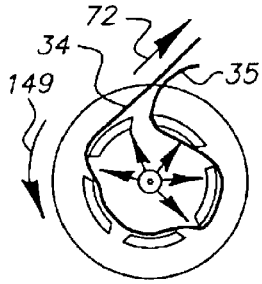
Figure 16:
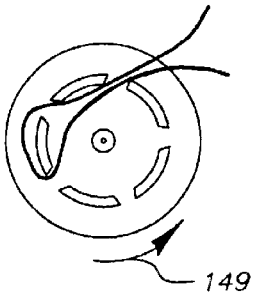
Figure 17:
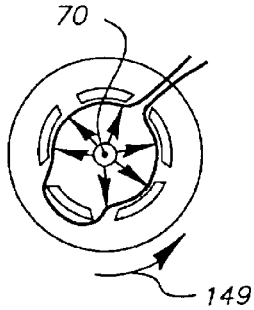
Figure 18:
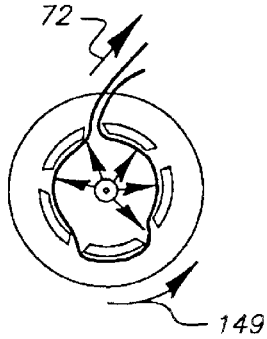
Figure 19:
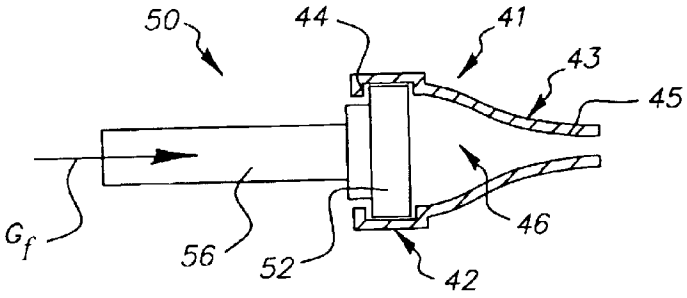
Figure 21:
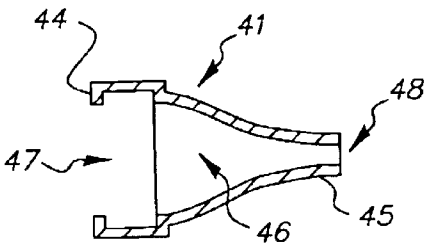
Figure 20:
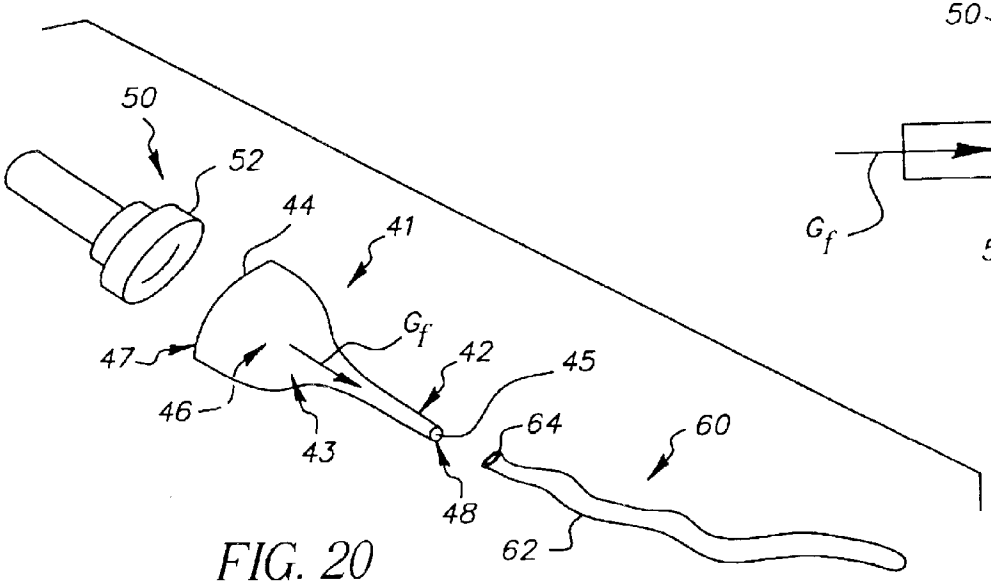

FIG, 2-A is a perspective view of a tether support device;

FIG. 2-B is a perspective view of an exemplary tether threading path;

FIG. 3 is a perspective view of spooled ribbon tether;

FIG. 4 is a side view of a tether support device in the form of a spool mated with a balloon valve stem;

FIG. 5 is a side view of one position of a mated tether support device or spool on a valve stem;

FIG. 6 is a perspective view of a balloon, a balloon valve and tether support device assembly in accordance with the present invention;

FIG. 7-A is a perspective view of a first tether threading path;

FIG. 7-B is a perspective view of a second tether threading path;

FIG. 8-A is a sectional view of the first tether threading path depicted in FIG. 7-A;

FIG. 8-B a is view of a third tether threading path;

FIG. 9-A Cutaway view of FIG. 8-A showing tether impingement by a winding mandrel;

FIG. 9-B is view of a fourth tether threading path;

FIG. 10 illustrates a fifth tether threading path using a 5-slot spool;

FIG. 11 shows the FIG. 10 tether impingement by a mandrel prior to winding;

FIG. 12 shows the tether position following half a winding turn of FIG. 11;

FIG. 13 shows a sixth tether threading path;

FIG. 14 shows the FIG. 13 tether impingement by a mandrel prior to winding;

FIG. 15 shows the tether position following half a winding turn of FIG. 14;

FIG. 16 shows a seventh tether threading path;

FIG. 17 shows the FIG. 16 tether impingement by a mandrel prior to winding;

FIG. 18 shows the tether position after a quarter turn from start of winding;

FIG. 19 shows a cross section of a third embodiment of the toy balloon valve adapter of the present invention, and a balloon valve head;

FIG. 20 is a perspective exploded view of the assembly of parts of FIG. 19; and FIG. 21 is a cross section through a centerline of the third embodiment of the toy balloon valve adapter of the present invention.

DESCRIPTION OF THE PREFERRED EMBODIMENTS

A toy balloon valve adapter 40, 41 is provided for enabling an existing balloon valve 50 to mate sealingly with different size balloons 60 during and after inflation. The toy balloon valve adapter 40, 41 includes a continuous wall 42 defining a balloon neck supporting member 43, that has a perimeter relatively different in size from that of a balloon neck supporting valve head 52 of a toy balloon valve 50. The balloon neck supporting member 43 may have a generally conical cross-section or a trough or boat shape cross-section, and includes a first end 44 and a second end 45. One of the first end and the second end, 44, 45 is a relatively larger end 44, and the other a relatively smaller end 45. In accordance with the present disclosure, two embodiments 40 (FIG. 1-C) and 41 (FIGS. 19–21) of the balloon valve adapter are provided. The location of the smaller end 45 as illustrated differs between the two embodiments.

The toy balloon valve adapter 40, 41 also includes an adapter cavity 46 located within the continuous wall 42 between the first end 44 and the second end 45 for receiving and containing a valve head 52 of the toy balloon valve 50. A first opening 47 at the first and larger end 44 leads into the adapter cavity 46 for receiving the valve head 52 of the toy balloon valve 50 into the adapter cavity 46. A second opening 48 located through the relatively smaller end 45 is suitable for allowing an inflation fluid Gf (FIG. 1-B) to flow from the toy balloon valve 50 into a supported balloon 60 for the purpose of inflating the balloon.

As is illustrated and further described below, in the first embodiment of the adapter 40, the neck of the balloon 60 is mounted and supported over the relatively larger end 44 during and after inflation. In contrast, in the third embodiment of the adapter 41, the neck of the balloon 60 is mounted and supported over the relatively smaller end 45 during inflation. For this particular embodiment, the neck of the supported balloon is held for example by the fingers against the relatively smaller end 45 during inflation. After inflation, the neck of the balloon can then be tied by suitable means, as is well known.

The toy balloon valve adapter 40, 41 can be made for example of a plastic material such as an elastomer, provided it is rigid enough to allow mounting or assembly of a balloon neck over the appropriate end, 44, 45. In either case, each opening 47, 48 has to fit tightly and in a sealing manner over or under the balloon valve head 52 and balloon neck in order to prevent leaking of the inflation fluid Gf during and after inflation of the supported balloon. Further details of the structure and use of the toy balloon valve adapter 40, 41 are provided in the drawings and descriptions thereof below.

FIG. 1-A is an exploded view of the various parts used in the present invention. As shown, the balloon valve adapter 40 is utilized for mating different sizes of, and odd sized, balloons 60 to an existing balloon valve 50 in order to provide effective sealing of such balloons during and after inflation without a risk of leaking or premature deflation. In a further embodiment of the invention there is provided a tether support device 20 that is mountable over a balloon valve stem 56 as a means for securing a tether to the assembled parts of the present invention, thereby retaining and keeping the balloon 60 from floating freely into the atmosphere.

In use, balloon valve stem 56 of balloon valve 50 is inserted through a sealing bore or opening 48 in the second and relatively smaller end 45 of the first embodiment of the balloon valve adapter 40 so that balloon valve head 52 lies at least partially within the adapter cavity 46 and is thereby protected from damage. In the case of the third embodiment of the balloon valve adapter 41, the balloon valve head 52 itself (of balloon valve 50) is inserted through a sealing bore or opening 47 in the first and relatively larger end 44 as shown. The tether support device 20, shown in the form of a spool, is suitable for use with the first embodiment of the balloon valve adapter 40, and has a bore 28 for installing onto the balloon valve stem 56 as best seen in FIGS. 4 and 5. As installed, it further secures the balloon valve adapter 40 into a sealing relationship with the balloon valve stem 56.

FIG. 1-A also illustrates a deflated balloon 60 having a neck portion 62 and a rim portion 64 that are too large ordinarily to effectively seal against an existing balloon valve head 52 of the balloon valve 50. In accordance with the present disclosure, it is installed over a support rim 49 of the adapter 40, and over at least one of a plurality of flanges F1 of the adapter 40 as can be best seen in FIGS. 1-B and 1-C. The phrase oversize balloons as used here refers to inflated balloon sizes that are larger than 12 inches in diameter, for example 17 and 18 inch size balloons that are typically used by automobile dealerships to attract attention.

FIG, 1-B is a vertical cross section through plane B—B of FIG. 1-A showing the relationship of the assembled balloon valve adapter 40 surrounding balloon valve head 52. Note that valve head 52 may be round, as in most valves, oval as depicted in the applicants U.S. Pat. No. 5,496,203 or any other shape. Note too that the valve sealing means are not shown in these drawings.

FIG. 1-C is a side view of the balloon valve adapter 40. Note that the tapered profile including the flanges F1 is designed to easily accept and seal with valve stem 56. Although the first embodiment of the balloon valve adapter 40 includes a plurality of flanges F1, as shown in the second embodiment (FIG. 1-G) it can comprise a plate-like or flat member, or in the third embodiment 41, it could be a single tapering flange between the first end 44, and the second end 45 suitable for receiving and sealing against a balloon neck portion of a supported toy balloon.

FIGS. 1-B and 1-C are best viewed when together. The configuration of a first embodiment of the toy balloon valve adapter 40 provides plural sealing surfaces of the flanges F1 that form a continuous wall 42 between the first end 44, and the second end 45 for receiving and sealing against a balloon neck 62 of a supported toy balloon 60. The plural sealing surfaces serve as means for redundanty sealing to prevent escape of gas from inflated balloon 60. Toy balloon adapter 40 may be essentially flat and resemble a common washer.

The second opening 48 through the relatively smaller end 45 of the toy balloon valve adapter 40 is sized to fit over and seal against the stem portion 56 of a toy balloon valve. FIGS. 19–21 show and describe the third embodiment of the balloon valve adapter 41 of the present invention that is suitable for supporting various sizes of balloons, including small neck rimmed balloons as later described.

FIG. 1-D is a top view of the toy balloon valve adapter 40 wherein the relatively larger end 44 is relatively larger than the valve head 52 and has an oval shape surrounding an oval shaped valve head 52, such as the valve head shown in applicant's U.S. Pat. No. 5,496,203, and an egg shaped or oval shaped balloon valve adapter 40. The non-round shape of the balloon valve adapter 40 having an axis ratio of a least 1:1.25 and less than 1:25 makes it considerably easier to stretch and install the neck of a balloon onto the adapter while maintaining an effective seal with the balloon. This ratio is applicable to both small balloons as well as to oversize balloons, where the balloon rolled neck 64, being thicker is typically difficult to stretch.

FIG. 1-E is a top view of a typical round valve head 52, such as the HeliValve™ manufactured by Premium Balloon Products of Sharon Center, Ohio, and an oval shaped balloon valve adapter 40 such as described in FIG. 1-D above.

FIG. 1-F is a top view of an oval balloon valve head 52, as described in FIG. 1-D, and a round toy balloon valve adapter 40. The generally circular shape of the first end 44 of the adapter balloon support member 43 is more applicable to small size balloons. Where the relatively larger end 44 of toy balloon valve adapter 40 is larger than the valve head 52 and satisfactorily performs the sealing function, it however is more difficult to mount larger sized balloons.

FIG. 1-G is a second embodiment of the toy balloon valve adapter of the present invention. As illustrated, in this embodiment, the wall 42 is relatively short and thick thus resulting in no cup-like cavity for containing the valve head, but a plate-like member for supporting the valve head. There is still a cavity located between the first end and the second end, and the first opening receives a stem of the toy balloon valve into it. The stem of the valve then comes out the other end through the second opening through the second end which thus allows an inflation fluid to flow through the stem of the toy balloon valve into a balloon on the balloon neck supporting member without leaking.

According to another aspect of the present invention, FIG. 2-A through FIG. 18 illustrate a toy balloon tether support device 20 and its use with the balloon valve and valve adapter of the present disclosure. As illustrated, the toy balloon tether support device 20 includes a generally cylindrical wall 21 defining an outer surface 24 and inner bore 28 including and inner surface 25 for frictionally mounting over the valve stem 56 of the toy balloon valve 50. It also includes plural slots 26 opening from the outer surface 24 into the inner bore 28 for forming various different paths to thread a lead end 34 of a tether 32 as shown and described below.

The toy balloon tether support device 20 further includes means 27, such as a relatively narrower portion of each slot leading into a slit, for receiving and locking a portion of the threaded lead end 34 that is pulled into it. This thereby effectively secures the tether 32 to the support device 20 by mounting it over the valve stem 56 of the toy balloon valve and impinging the threaded lead end 34 within the bore 28 against the inner surface 25 of the inner bore.

FIG. 2-A shows a perspective view of the tether support device 20 in the form of a spool having a flange 22, a hub 23, and a plural number of slots 26. The tether support device 20 also includes a through bore 28 adapted to receive valve stem 56 (shown in FIGS. 4 and 5) of balloon valve assembly 50. The purpose of tether support device 20 is to secure an attached ribbon tether 39 (FIG. 6) to the assembled balloon valve 50 and to the balloon valve adapter 40 as seen in FIG. 1-A and FIG. 6. For clarity, toy balloon valve adapter 40 is not shown in FIGS. 4–6 since it is optional, meaning that the tether support device 20 can be means to secure a tether to balloon valve assembly 50 even when the toy balloon valve adapter 40 is not used. In illustrations herein ribbon will be shown as tether material, however, string or other material can be employed.

FIG. 2-B is a perspective view of ribbon tether 32 from a supply spool 30. As shown, the tether 32 has a first end 34 threaded through two of the plurality of slots 26 prior to insertion of a winding mandrel 140 into the bore 28 of the device 20. The winding mandrel 140 contains drive dogs 144 that engage slots 26 for the purpose of turning the tether support device or spool 20 to wind the ribbon thereon. Winding mandrel 140 is bullet shaped to displace the tether or ribbon 32 toward inner wall 25 of a generally cylindrical wall that will also be referred to as tether support hub 23 and further described in FIG. 7A. Winding mandrel 140 may have a small diameter cylindrical portion (not shown) extending from a bullet tip 142 to remain within bore 28 during tether threading for the purpose of deflecting the tether first end 34 toward hub interior surface 25 and then through slots 26.

Note also, a single slot (not shown) could direct the tether first end 34 into bore 28 for the purpose of impingement by winding mandrill 140. Use of an even number of slots is optional, however, the inclusion of a deflecting protrusion aids in directing the tether first end 34 toward interior surface 25 and impingement therewith and avoid entangling the tether. In practice, it has been found that the degree of impingement will vary due to variations in part tolerances; tether thickness being one example, undesirable tether slippage may occur thereby causing premature release. Therefore, heat staking of the tether first end 34 to the tether support hub 23 may be employed for securely fastening the tether to the hub, as for example, in a manner similar to that taught in U.S. Pat. No. 5,547,413 entitled "Heat Staked Tether for Toy Balloons".

FIG. 3 is a perspective view of a tether or ribbon 38 wound tightly around external surface 24 of tether support hub 23. First end 34 of ribbon 32 is shown passing through one of a plurality of slots 26 to lie adjacent to hub interior surface 25 where it is in a position to be captured by impingement with balloon support such as the valve stem 56 when assembled as seen in FIGS. 4 and 5. Tether or ribbon distal end 36 is secured to the spooled ribbon by any suitable means, for example by heat-staking as shown at heat-staking points 76. Tether first end 34 lies adjacent to hub internal surface 26 to permit impingement as will be described.

FIG. 4 is a side view of balloon valve 50 mated with a tether support device 20 by inserting valve stem 56 through bore 28 in tether support hub 23 in direction of arrow 48. Tether support hub 23 may incorporate an optional flange 22 for supporting wound ribbon 38. Balloon valve stems typically have a taper which causes impingement of ribbon first end 34 between hub interior surface 25 and exterior surface of stem 56 thereby securing an attached ribbon tether 39 to balloon valve without tying as seen in FIG. 6.

FIG. 5 is a side view of typical balloon valve 50, such as applicants U.S. Pat. No. 5,496,203 "Balloon Valve Assembly," having a valve head 52 for supporting the neck portion 62 of balloon 60 as best seen in FIG. 6, a stem portion 56 having a taper which is largest adjacent the valve head 52. Tether support device 20 is shown near maximum interference and locking relationship with valve stem 56.

FIG. 6 is a perspective view of a helium-filled balloon 60 having a neck portion 62 mounted onto the balloon valve 50, assembled with tether support device or spool 20 and thereby capturing the first end 34 of unwound attached ribbon tether 39 without the need for tying a knot in attached ribbon tether 39.

FIG. 7-A is a perspective view of a first preferred tether threading path and means for impingement of a first end 34 of ribbon 32 from supply spool 30 by mandrel 140 during winding operation. Ribbon first end 34 is inserted inwardly by hand or machine (not shown) through one of a plurality of slots 26 in tether support hub 23 and then outwardly through a second of the plurality of slots 26 leaving a length approximating one to four hub diameters extending outwardly as shown. This thereby leaves a substantial portion outside of tether support hub exterior surface 24 after full insertion of mandrel 140 for the purpose of capturing tether first end 34 as best depicted in FIG. 12.

FIGS. 7-A to 18 depict tether threading paths that place the ribbon off the center line of mandrel 140 so that mandrel nose 142 avoids tangling with the ribbon and will instead displace ribbon first end 34 toward hub inner surface 25 for the purpose of temporary impingement with the mandrel during the winding operation. Note that when the mandrel is withdrawn a portion of ribbon first end 341 as best seen in FIG. 3, will remain in close proximity to hub inner surface 25 for the purpose of later locking impingement with balloon support stem 56 thereby securing the ribbon tether 38 without the need for tying.

FIG. 7-B is a perspective view of a second tether threading path similar to that of FIG. 7-A and whereby the ribbon first end 34 passes through a third slot 26 and then back through the first one of the plurality of slots. A loop portion 35 exterior to support hub surface 24 will be drawn tight as the tether support hub 23 is rotated, especially if the tether support hub 23 is rotated in the direction of arrow 149.

FIG. 8-A is a sectional view of the second tether threading path depicted in FIG. 7. FIG. 8-B is a view of the second tether threading path of FIG. 7-A. FIG. 9-A is a sectional view of FIG. 8-A showing ribbon impingement, depicted by arrows 70, caused by an interference relation with winding mandrel 140. FIG. 9-B is view of a third tether threading path as shown. Note that FIGS. 10–18 show a plurality of five slots 26 in tether support hub 23 (un-numbered to permit greater clarity with concepts depicted). Also note that having an odd number of slots the tether support hub 23 first end 34 is positioned away from the centerline of mandrill 140 and thereby avoids entanglement therewith.

FIGS. 10–12 plus FIG. 15 depict the same tether threading path shown in FIG.10 with ribbon 32 threaded in path as shown. FIG.11 is the same as FIG. 10 but with the tether impinged, and in FIG. 12 the tether support hub 23 is rotated in a half turn in direction of arrow 149 which causes tether first end 34 to be wrapped around external surface 24, and as the hub is further rotated as shown in FIG. 15, the tether first end 34 will be forced into intimate contact for the purpose of allowing significant tension in the direction of arrow 72 to be applied to the tether to prevent inadvertent unwinding especially by coning, until release is desired.

FIGS. 13–14 and 17–18 depict a fourth tether threading path as shown. The insertion of the mandrel will cause tether or ribbon loop 35 external to tether support hub 23 to be drawn into contact with the hub and to be impinged by overlaying windings of ribbon. Note also arrow 72 shown in FIG. 15 that depicts tension being applied to the tether or ribbon as it is wound tightly around the hub.

FIG. 16 shows a fifth tether threading path that performs satisfactorily although more difficult to thread.

FIGS. 19–21 show a third embodiment of the invention for use with balloons having a very small neck opening for example balloons known as "animal twisties" and also known as 260's for their inflated size, 2 inch diameter by 60 inches long. When used with "animal twisties" balloons the balloon valve adapter 41 and balloon valve assembly 50 are normally used in conjunction with a pump, for example the low pressure pump shown in U.S. Pat. No. 5,145,338, for retaining fluid within the balloon until it can be conveniently closed by hand tying or use other closure devices, whereupon the balloon valve adapter 41 may be withdrawn and used to fill additional balloons.

FIGS. 19–21 show the third embodiment of the toy balloon valve adapter 41 configured for use with smaller than normal sized balloons 60 wherein the relatively larger end 44 and first opening 47 are sized to fit upside down over valve head 52 of a toy balloon valve assembly 50. The relatively smaller end 45 and second opening 48 are sized to fit into and seal against the inner surface of a neck of a toy balloon 60 being supported for the purpose of filling with fluid Gf.

FIG. 19 is a cross section of the third embodiment of the balloon valve adapter 41 of the present invention for sealingly mating with the valve head 52 of balloon valve assembly 50 for the purpose of adapting the balloon valve to permit the filling of balloons having a smaller than normal balloon rolled neck portion 64 as best seen in FIG. 20.

The material selected for molding the balloon valve adapter 41 should have elastic properties, as for example an elastomer, to facilitate the insertion of valve head 52 into bore 47 seen in FIG. 20, and to create a fluid tight seal between the balloon valve assembly 50 and the neck of the balloon 60 to permit filling the balloon with out fluid leakage.

FIG. 20 is a perspective exploded view of the component assemblies used to inflate small neck sized balloons, consisting of balloon valve assembly 50, toy balloon valve adapter 41 and a small neck sized balloon 60. In use balloon rolled neck 64 is pulled over adapter wall 42 and held for example with the fingers to create a seal for filling the balloon.

FIG. 21 is a cross section through the centerline of toy balloon valve adapter 41 configured for use with small size balloons. First opening 47 is sufficiently large to accommodate valve head 52 and second opening 48 is small enough for the purpose of fitting within balloon neck portion 62 in a sealing manner and enabling the filling of the smaller than normal sized balloons.

As can be seen, there has been a toy balloon valve adapter provided for mounting over an existing balloon valve and for enabling the existing balloon valve to mate sealingly with different size balloons. The toy balloon valve adapter includes a continuous wall defining a balloon neck supporting member having a perimeter relatively different in size from a perimeter of the balloon neck supporting valve head of the toy balloon valve. The balloon neck supporting member includes a first end and a second end, wherein one of the first end and the second end is a relatively larger end and the other is a relatively smaller end. The toy balloon valve adapter also includes a cavity defined by the continuous wall and located between the first end and the second end for receiving and containing the valve head of a toy balloon valve. A first opening is provided into the cavity through the relatively larger end for receiving the valve head of the toy balloon valve into the cavity, and a second opening is provided through the relatively smaller end for allowing an inflation fluid to flow through the toy balloon valve into a supported balloon without leaking.

Having described my invention it will be apparent that other variations are possible without departing from basic concepts presented.

I claim:

1. A toy balloon valve adapter mountable over an existing balloon valve for mating sealingly with necks of different size balloons, the toy balloon valve adapter comprising:

(a) a continuous wall defining a balloon neck supporting member having a perimeter relatively different in size from a perimeter of a balloon neck supporting valve head of the existing toy balloon valve, said balloon neck supporting member including a first end and a second end, one of said first end and said second end being a relatively larger end and the other being a relatively smaller end;

(b) a cavity defined by said continuous wall and located between said first end and said second end for receiving and containing the balloon neck supporting valve head of the existing toy balloon valve;

(c) a first opening into said cavity through said relatively larger end for receiving said balloon neck supporting valve head of said existing toy balloon valve into said cavity;

(d) a second opening through said relatively smaller end for allowing an inflation fluid to flow through said existing toy balloon valve into a supported balloon without leaking; and (e) more than two flange areas between said first end and said second end, each said flange area having a relatively different size diameter for receiving and effectively sealingly mating and supporting against necks of different size supported toy balloons after inflation.

2. The toy balloon valve adapter of claim 1, wherein said relatively larger end has a generally circular shape.

3. The toy balloon valve adapter of claim 1, wherein said second opening through said relatively smaller end is sized to fit over and seal against a stem portion of said existing toy balloon valve.

4. The toy balloon valve adapter of claim 1, wherein said relatively larger end has an oval shape.

5. The toy balloon valve adapter of claim 1, wherein said continuous wall is made of an elastic material.

6. The toy balloon valve adapter of claim 1, wherein said relatively larger end is sized to fit upside down over balloon neck supporting valve head of said existing toy balloon valve, and said relatively smaller end is sized to fit into and seal against the inner surface of a neck of a toy balloon being supported.

7. The toy balloon valve adapter of claim 1, wherein said relatively larger end is sized to fit and seal the necks of 14 inch to 20 inch large balloons.

8. The toy balloon valve adapter of claim 1, wherein said continuous wall includes a balloon neck sealing rim at said first end.

9. The toy balloon valve adapter of claim 1, wherein each of said flange areas is tapered from said relatively larger end towards said relatively smaller end.

10. The toy balloon valve adapter of claim 3, wherein said relatively larger end includes a rim for fitting into and sealing against the inner surface of a neck of a toy balloon being supported.

11. The toy balloon valve adapter of claim 4, wherein said oval relatively larger end has an axis ratio of a least 1:1.25 and less than 1:2.5 for making it considerably easier to stretch and install the neck of a balloon onto the adapter while maintaining an effective seal with the balloon.

12. A tethered toy balloon assembly comprising:

(a) a toy balloon;

(b) a balloon valve for allowing and controlling inflation fluid into said toy balloon, said balloon valve including a valve stem and a balloon neck supporting valve head;

(c) a balloon valve adapter for mounting over said balloon valve and for enabling an existing balloon valve to mate sealingly with different size balloons, the toy balloon valve adapter comprising:

(i) a continuous wall defining a balloon neck supporting member having a perimeter relatively different in size from a perimeter of said balloon neck supporting valve head of said toy balloon valve, said balloon neck supporting member including a first end and a second end, one of said first end and said second end being a relatively larger end and the other a relatively smaller end;

(ii) a cavity defined by said continuous wall and located between said first end and said second end for receiving and containing said valve head of a toy balloon valve;

(iii) a first opening into said cavity through said relatively larger end for receiving said valve head of said toy balloon valve into said cavity; and (iv) a second opening through said relatively smaller end for allowing an inflation fluid to flow through said toy balloon valve into a supported balloon without leaking;

(d) a tether support device having a generally cylindrical wall defining an outer surface and an inner bore including an inner surface for frictionally mounting over said valve stem of said toy balloon valve, and plural slots opening from said outer surface into said inner bore for forming various different paths to thread a lead end of a tether; and (e) a tether threaded through at least one of plural slots of said tether support device for mounting over said valve stem of said toy balloon valve and for impinging said threaded lead end against said inner surface of said inner bore.

13. A toy balloon tether support device comprising:

(a) a generally cylindrical wall defining an outer surface and an inner bore including an inner surface for frictionally mounting over a valve stem of a toy balloon valve, (b) plural slots opening from said outer surface into said inner bore for forming various different paths to thread a lead end of a tether; and (c) means within each of said plural slots for receiving and locking a portion of said threaded lead end of said tether, thereby effectively securing said tether to said support device by locking said portion within said means and impinging said threaded end by inserting said inner bore over said valve stem of said toy balloon valve.

14. The toy balloon tether support device of claim 13, including a flange portion connected to said cylindrical wall.

15. The toy balloon tether support device of claim 13, wherein said plural slots comprise and odd number of such slots.

16. The toy balloon tether support device of claim 13, wherein said wall is made of a plastic material.

17. A toy balloon valve adapter assembly for enabling an existing balloon valve to mate sealingly with different size balloons, the toy balloon valve adapter assembly comprising:

(A) a toy balloon valve having a toy balloon neck supporting valve head for sealing and supporting a balloon neck of a first size; and (B) an adapter including:

(a) a continuous wall defining a balloon neck supporting member having a perimeter relatively different in size from the perimeter of ballon neck supporting valve head of said toy balloon valve, neck supporting member including a first end and a second end;

(b) a cavity defined by said continuous wall and located between said first end and said second end for supporting said valve head of said toy balloon valve;

(c) a first opening into said cavity through said first end for receiving a stem of said toy balloon valve into said cavity; and (d) a second opening through said second end for allowing an inflation fluid to flow through said stem of said toy balloon valve into a balloon on said balloon neck supporting member without leaking.

18. The toy balloon valve adapter assembly of claim 17, wherein said wall is relatively short and thick for defining a plate-like balloon neck supporting member.

19. A displayable toy balloon assembly comprising:

(a) a toy balloon; and (b) a balloon neck sealing and supporting subassembly for sealing and supporting said displayable toy balloon after inflation, said sealing and supporting subassembly including:

(i) a toy balloon valve having a toy balloon valve head for sealing and supporting a balloon neck of first size; and (ii) an adapter having an adapter head, relatively larger than said toy balloon valve head, for mounting over said toy balloon valve head of said toy balloon valve for sealing and supporting a balloon neck of a second size without a risk of premature deflation, said second size being larger than said first size.

20. The displayable toy balloon assembly of claim 19, wherein said adapter includes a continuous wall defining (a) a balloon neck supporting portion having a perimeter relatively larger in size than a perimeter of said first head of said first member (b) a cavity for receiving and containing said first head of said first member (c) a first opening into said cavity through a first end thereof for receiving said first head of said first member into said cavity, and (d) a second opening through said first a second and opposite end for allowing an inflation fluid to flow through said first member into said displayable toy balloon without leaking.

* * * * *